US009829831B2

(12) United States Patent
Hirai et al.

(10) Patent No.: US 9,829,831 B2
(45) Date of Patent: Nov. 28, 2017

(54) WET DEVELOPMENT DEVICE AND WET IMAGE FORMING APPARATUS

(71) Applicant: Konica Minolta, Inc., Chiyoda-ku, Tokyo (JP)

(72) Inventors: Atsuto Hirai, Ikoma (JP); Takeshi Maeyama, Ikeda (JP); Yuya Sato, Fuchu (JP); Kunitomo Sasaki, Takatsuki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/744,685

(22) Filed: Jun. 19, 2015

(65) Prior Publication Data

US 2015/0370197 A1 Dec. 24, 2015

(30) Foreign Application Priority Data

Jun. 20, 2014 (JP) ..... 2014-127183

(51) Int. Cl.
*G03G 15/11* (2006.01)
*G03G 15/10* (2006.01)

(52) U.S. Cl.
CPC ..... *G03G 15/11* (2013.01); *G03G 15/104* (2013.01)

(58) Field of Classification Search
CPC ..... G03G 15/10; G03G 15/101; G03G 15/104
See application file for complete search history.

(56) References Cited

U.S. PATENT DOCUMENTS 2,297,691 A * 10/1942 Carlson ..... G03G 5/08207 101/467
6,163,673 A * 12/2000 Shindo ..... G03G 15/101 399/237
2005/0078984 A1 4/2005 Fujita et al.
2011/0274466 A1* 11/2011 Izawa ..... G03G 15/0815 399/239
2014/0016976 A1* 1/2014 Horemans ..... G03G 15/11 399/348

FOREIGN PATENT DOCUMENTS

JP 2005-121816 A 5/2005
JP 2006-030719 A 2/2006
JP 2009-169321 A 7/2009

* cited by examiner

*Primary Examiner* — Sevan A Aydin
(74) *Attorney, Agent, or Firm* — Buchanan Ingersoll & Rooney PC

(57) ABSTRACT

The present wet development device includes a developer carrying member, a supply member that supplies a liquid developer to the developer carrying member, a charger that charges the liquid developer on the developer carrying member, a cleaner that removes the liquid developer on the developer carrying member, and a bias applying member that applies alternating bias in contact with the developer carrying member before removing by the cleaner. In a direction in alignment with an axis of rotation of the developer carrying member, a range to which the alternating bias is applied by the bias applying, member is located within a range in which the liquid developer is supplied onto the developer carrying member.

5 Claims, 8 Drawing Sheets

FIG.11

| | LENGTH OF CHARGER (j) | LENGTH OF LIQUID DEVELOPER SUPPLY (h) | LENGTH OF ALTERNATING BIAS APPLYING MEMBER (i) | PRESENCE/ ABSENCE OF CHARGE ELIMINATING CHARGER | TONER DEPOSIT EVALUATION |
|---|---|---|---|---|---|
| | | | | | CHARGER OUTPUT: 0.1mA/m |
| COMPARATIVE EXAMPLE 1 | 240mm | 250mm | 254mm | ABSENT | F(DEPOSITED THROUGHOUT SURFACE) |
| EXAMPLE 1 | 240mm | 250mm | 236mm | ABSENT | A(DEPOSITED ONLY AT BOTH ENDS) |
| EXAMPLE 2 | 240mm | 250mm | 246mm | ABSENT | A(NOT DEPOSITED) |
| EXAMPLE 3 | 240mm | 250mm | 246mm | PRESENT | A(NOT DEPOSITED) |

WET DEVELOPMENT DEVICE AND WET IMAGE FORMING APPARATUS

This application is based on Japanese Patent Application No. 2014-127183 filed with the Japan Patent Office on Jun. 20, 2014, the entire content of which is hereby incorporated by reference.

BACKGROUND OF THE INVENTION

Field of the Invention

The present invention relates to a printer, a copier, a facsimile machine, and other electrophotographic image forming apparatuses, and more particularly to a wet development device and a wet image forming apparatus that employ wet development as a development method.

Description of the Related Art

Japanese Laid-Open Patent Publication Nos. 2009-169321, 2005-121816, and 2006-30719 disclose a wet development device and a wet image forming apparatus using wet development.

Japanese Laid-Open Patent Publication No. 2009-169321 discloses a configuration in which the lengths in the axial direction of a photoconductor cleaning roller, a photoconductor cleaning roller blade, a photoconductor cleaning blade, and a groove region of an application roller are defined, and the length in the axial length of the photoconductor cleaning roller is longer than the photoconductor cleaning roller blade and shorter than the cleaning blade. The length of the groove region of the application roller is shorter than the photoconductor cleaning roller blade.

Given that the groove region width of the application roller is generally equal to the developer supply width, the following relation holds based on the disclosure of Japanese Laid-Open Patent Publication No. 2009-169321: the length of developer supply<the length of the photoconductor cleaning roller blade<the length of the photoconductor cleaning roller<the length of the photoconductor cleaning blade.

Japanese Laid-Open Patent Publication No. 2005-121816 discloses a configuration related to removal of residual toner on an intermediate transfer unit. Improving the dispersion state of residual toner on the intermediate transfer unit is described, and the use of alternating bias as the means for improvement is disclosed.

Japanese Laid-Open Patent Publication No. 2006-30719 discloses a technique in which assistant means is provided for weakening aggregation of toner particles in cleaning of a developer carrying member. Only a charge eliminator and an alternating bias applying roller are disclosed as assistant means.

Japanese Laid-Open Patent Publication Nos. 2005-121816 and 2006-30719 disclose the provision of a member for applying alternating bias upstream of the cleaning blade but does not describe the length in the axial direction thereof.

SUMMARY OF THE INVENTION

In wet development, a thin layer is formed on the development roller using a developer including not-charged toner particles, and the toner particles are thereafter charged on the development roller and developed. If toner particles are charged using a charger as a toner charging member, the adherence of toner particles to the development roller surface increases to make cleaning difficult only with a cleaning blade.

Moreover, since toner particles adhere to the surface of the development roller and reach the cleaning blade in a localized state, the blocked toner particles aggregate at a wedge between the blade and the development roller and on the upper surface of the blade and are deposited over time. This is called a toner deposit.

It is difficult to convey this toner deposit from the blade to the developer tank, and the toner deposit is collected and wasted during cleaning of the wet development device, which is not cost-effective. If the toner deposit is not removed and left during suspension of the wet development device, the carrier liquid in the deposit is dried to form solid toner.

In order to prevent the toner deposit, it is necessary to remove toner particles adhering to the development roller surface before reaching the cleaning blade and to re-disperse the toner particles in the developer. For this purpose, it is effective to bring the alternating bias applying roller into contact with the development roller upstream of the cleaning blade and to form an alternating electric field between the alternating bias applying roller and the development roller.

An alternating electric field is formed to allow the toner particles adhering to the development roller to be electrically removed and re-dispersed into the liquid developer.

It is possible to remove toner particles from the development roller also by applying direct bias. But on the contrary the toner particles adhere to the bias applying roller, and a toner deposit is formed in the same manner at the cleaning blade for the bias applying roller.

In order to electrically remove toner particles from the development roller and re-disperse the toner particles into the liquid developer, it is necessary to form an electric field for causing the toner particles to start moving and to allow toner to reciprocate in the nip between the alternating bias applying roller and the development roller, and high-amplitude and high-frequency alternating bias is required. In the present systems, amplitude of 300V and frequencies of 10 kHz or so are preferable.

Alternating bias can be formed when liquid developer is present between the development roller and the alternating bias applying roller, because the liquid developer is insulative. However, if there is an area where the development roller and the alternating bias applying roller are in direct contact with each other, large current flows during application of alternating bias, and a desired bias cannot be formed. As a result, the toner cannot be re-dispersed and a toner deposit is formed. In some cases, overcurrent is locally produced (leak occurs) to cause damage to the roller.

Although it is possible to form a desired bias by increasing the capacity of power supply for alternating bias to allow more current to flow, the probability that local overcurrent is produced and the value of the overcurrent increase, and the possibility of causing damage to the development roller increases. Feeding large current is particularly dangerous.

The present invention is made in view of the problems above and an object of the present invention is to provide a wet development device and a wet image forming apparatus including a structure capable of suppressing a toner deposit without causing damage to the development roller.

According to an aspect, a wet development device includes a developer carrying member, a supply member that supplies a liquid developer to the developer carrying member, a charger that charges the liquid developer on the developer carrying member, a cleaner that removes the liquid developer on the developer carrying member, and a bias applying member that applies alternating bias in contact with the developer carrying member before removing by the cleaner. In a direction in alignment with an axis of rotation of the developer carrying member, a range to which the alternating bias is applied by the bias applying member is located within a range in which the liquid developer is supplied onto the developer carrying member.

A wet image forming apparatus includes an image carrying member, an image forming unit that forms an electrostatic latent image on the image carrying member, and the wet development device described above that develops the electrostatic latent image formed on the image carrying member by the image forming unit.

According to another aspect, a wet image forming apparatus includes an image carrying member capable of rotating, an image forming unit that forms an electrostatic latent image on the image carrying member, a developer carrying member capable of rotating about an axis generally parallel to an axis of rotation of the image carrying member, a charger that charges a liquid developer on the developer carrying member, a supply member that supplies the charged liquid developer on the developer carrying member to the image carrying member to develop the electrostatic latent image and form a developer image, a transfer unit that transfers the developer image onto an object, a bias applying member that applies alternating bias to the liquid developer on the image carrying member after the developer image is transferred onto the object, and an image carrying member cleaner that removes the liquid developer on the image carrying member after the alternating bias is applied by the bias applying member. In a direction in alignment with an axis of rotation of the developer carrying member, a range to which alternating current is applied by the bias applying member is located within a range in which the liquid developer is supplied onto the developer carrying member.

According to a further aspect, a wet image forming apparatus includes an image carrying member capable of rotating, an image forming unit that forms an electrostatic latent image on the image canying member, a developer carrying member capable of rotating about an axis generally parallel to an axis of rotation of the image carrying member, a charger that charges a liquid developer on the developer carrying member, a supply member that supplies the charged liquid developer on the developer carrying member to the image carrying member to develop the electrostatic latent image and forma developer image, an intermediate transfer member that turns such that a surface thereof moves in accordance with rotation of the image carrying member and onto which the developer image on the image carrying member is transferred, a transfer unit that transfers the developer image on the intermediate transfer member onto an object, a bias applying member that applies alternating bias to the liquid developer on the intermediate transfer member after the developer image is transferred onto the object, and an intermediate transfer member cleaner that removes the liquid developer on the intermediate transfer member after the alternating bias is applied by the bias applying member. In a direction in alignment with an axis of rotation of the developer carrying member, a range to which alternating current is applied by the bias applying member is located within a range in which the liquid developer is supplied onto the developer carrying member.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 11 shows the evaluation results of Examples 1 to 3 and Comparative. Example 1.

DESCRIPTION OF THE PREFERRED EMBODIMENTS

A wet development device and a wet image forming apparatus in the embodiments of the present invention will be described below with reference to the figures. In the embodiments described below, the scope of the present invention is not limited to the number, quantity, and others specified in the description, if any, unless otherwise specified. The same parts and corresponding parts are denoted with the same reference signs and an overlapping description may not be repeated. It is initially intended that the configurations in the embodiments are combined as appropriate.

[Related Art]

Figure 1:
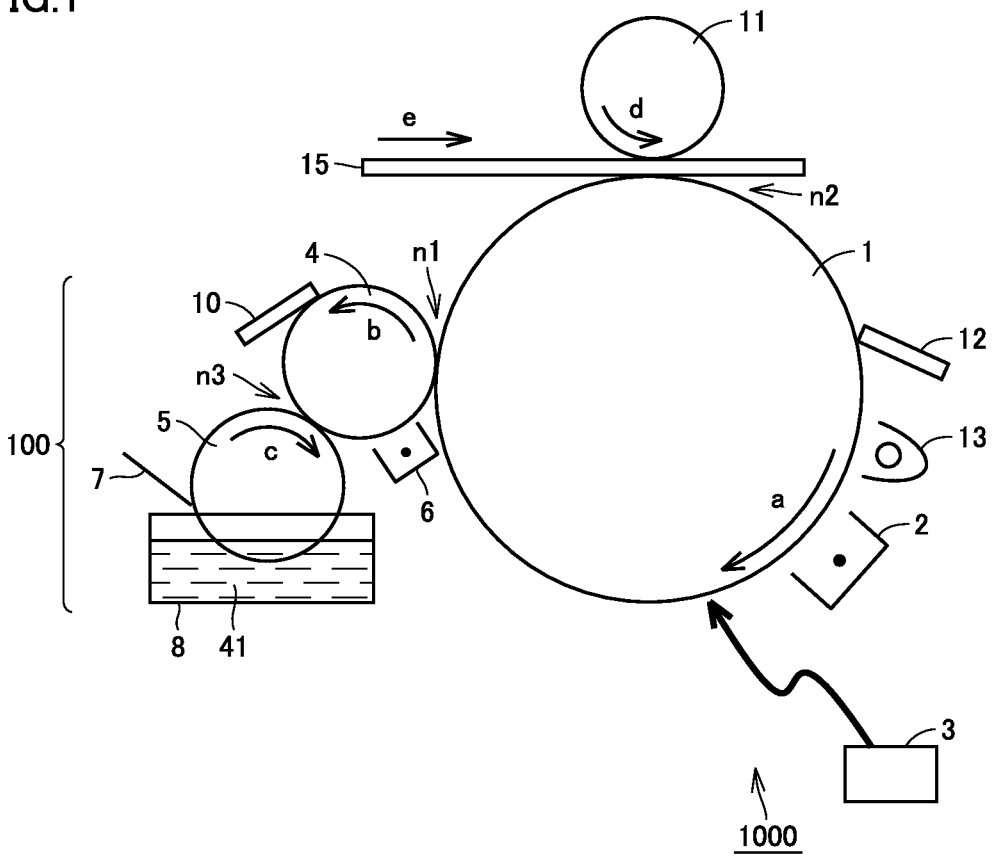
FIG. 1 is a diagram showing an overall configuration of a wet image forming apparatus in a related art.

Referring to FIG. 1, a schematic configuration of a wet development device 100 that employs a general electrophotographic process using a liquid developer and a wet image forming apparatus 1000 including this wet development device 100 will be described as a related art, FIG. 1 is a diagram showing an overall configuration of wet image forming apparatus 1000 in a related art.

Wet image forming apparatus 1000 has a photoconductor 1. Photoconductor 1 rotates in the direction of the arrow a in the figure about the axis extending in one direction. Photoconductor 1 is charged to a uniform potential by a charging device 2. Photoconductor 1 is thereafter exposed by an exposure device 3 as an image forming unit for forming an electrostatic latent image, so that the potential of an image section attenuates, and an electrostatic latent image is formed on photoconductor 1. Photoconductor 1 having the electrostatic latent image formed thereon is conveyed to a development section n1 that is opposed to a development roller 4.

Development roller 4 rotates in the direction b in the figure about the axis of rotation generally parallel to the axis of rotation of the photoconductor. A liquid developer 41 on development roller 4 comes into contact with photoconductor 1 at development section n1. Liquid developer 41 includes, as main components, a coloring agent, resin toner particles, and a dispersant (carrier liquid) for dispersing toner particles.

The toner particles on development roller 4 are charged, and the toner particles move toward photoconductor 1 at development section n1 on photoconductor 1 and move toward development roller 4 at a background section. The toner particles developed on photoconductor 1 are conveyed to a transfer section n2 that is opposed to a transfer roller 11. At transfer section n2, an object (paper) 15 is conveyed in the direction of the arrow e, and the toner particles on photoconductor 1 are transferred to object 15 by applying a voltage of polarity opposite to that of the toner particles to transfer roller 11. Object 15 having the toner particles transferred thereon is conveyed to a fixing unit (not shown) for fixing the toner image.

On photoconductor 1 after passing through the transfer section, a cleaner 12 is provided for collecting the residual toner particles and the carrier liquid on photoconductor 1 that are left after the transfer. After the toner particles and the carrier liquid are collected, photoconductor 1 is exposed by an eraser lamp 13 to cancel the latent image potential.

Toner particles and carrier liquid not developed and left are present also on development roller 4 after passing through development section n1. In order to remove the toner particles and the carrier liquid, a cleaning blade 10 is provided as a cleaner. The process described above is repeated to successively print an image on object 15.

[Wet Development Device 100]

Wet development device 100 will now be described in details. Wet development device 100 includes development roller 4 as a developer carrying member for supplying liquid developer 41 to photoconductor 1 serving as an image carrying member as described above, a supply roller 5 as a supply member for supplying liquid developer 41 to development roller 4, a charger 6 serving as a charger for charging liquid developer 41 on development roller 4, and cleaning blade 10 as a cleaner for removing liquid developer 41 on development roller 4.

Liquid developer 41 composed of toner particles made of a coloring agent and resin and a carrier liquid for dispersing the particles is stored in a developer tank 8. Supply roller 5 is partially soaked in liquid developer 41 and rotates in the direction c in the figure. With the rotation of supply roller 5, liquid developer 41 is drawn up, and liquid developer 41 is restricted to a certain film thickness by a restriction blade 7 provided in contact with supply roller 5.

After liquid developer 41 is restricted to a certain film thickness, liquid developer 41 is conveyed to a nip n3 of development roller 4 and passed to development roller 4. Liquid developer 41 passed to development roller 4 is conveyed to the section opposed to charger 6 with the rotation of development roller 4, and the toner particles in liquid developer 41 are charged by current flowing from charger 6 into development roller 4. Liquid developer 41 is thereafter conveyed to development section n1, which is a nip of photoconductor 1, and an electrostatic latent image on photoconductor 1 is developed by liquid developer 41.

The toner particles and the carrier liquid not used in development and left on development roller 4 are conveyed to the section opposed to cleaning blade 10 with the rotation of development roller 4 and blocked to be collected by cleaning blade 10.

The liquid developer collected by cleaning blade 10, which has a toner concentration different from the original liquid developer 41, is recovered into a tank (not shown) different from developer tank 8 and then returned to developer tank 8 after the toner concentration is adjusted. A urethane or NBR rubber roller or an anilox roller having depressions on the surface can be used as supply roller 5. A urethane or NBR rubber roller can be used as development roller 4.

Figure 2:
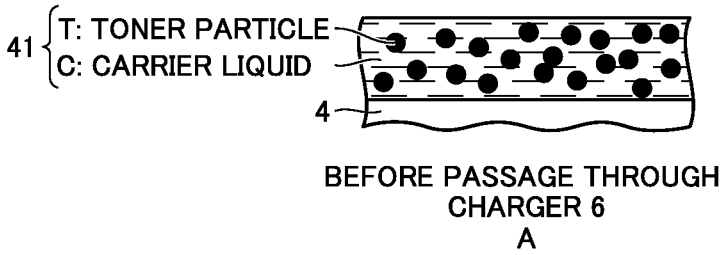
FIG. 2 is a schematic diagram showing a state of liquid developer before passing through a charger.
Figure 3:
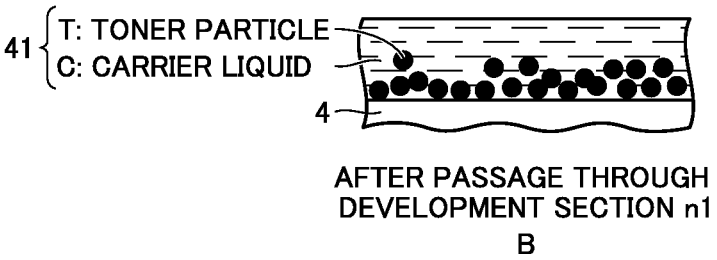
FIG. 3 is a schematic diagram showing a state of liquid developer on a development roller after passing through a development section.
Figure 4:
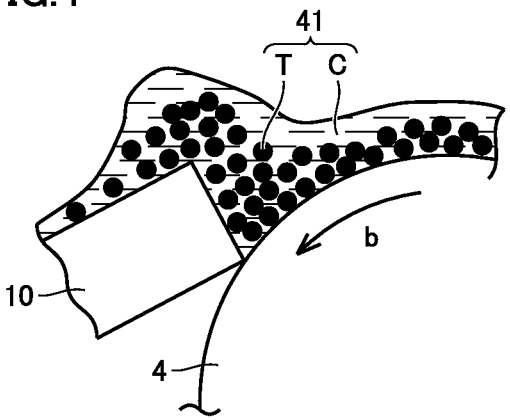
FIG. 4 is a schematic diagram showing a toner deposit on the development roller.

Referring now to FIG. 2 to FIG. 4, liquid developer 41 supplied on development roller 4 will be described. FIG. 2 is a schematic diagram showing a state of liquid developer 41 before passing through charger 6. FIG. 3 is a schematic diagram showing a state of liquid developer 41 on development roller 4 after passing through development section n1. FIG. 4 is a schematic diagram showing a toner deposit on development roller 4.

Referring to FIG. 2, liquid developer 41 stored in developer tank 8 and supplied onto development roller 4 through supply roller 5 is present with toner particles T uniformly dispersed in carrier liquid C. In this state, with charging by charger 6 and an electric field (electric field applied to the background section) at development section n1, toner particles T receive force and are pressed against development roller 4.

As a result, as shown in FIG. 3, toner particles T, passing through development section n1, present at a location corresponding to the background section of the image are localized in the vicinity of the surface of development roller 4. It follows that toner particles T adhering to the surface of development roller 4 are present.

Referring to FIG. 4, when liquid developer 41 reaches the contact section with cleaning blade 10 in this state, toner particles T are deposited on the wedge section where cleaning blade 10 and development roller 4 are in contact with each other. The vicinity of the surface of liquid developer 41 is in a state in which carrier liquid C is rich, and more carrier liquid C flows down on cleaning blade 10.

As a result, a toner deposit having a high concentration of toner particles T is formed. The deposition of toner particles T increases over time, and toner particles T arrive at the upper portion of cleaning blade 10. The toner deposit has poor flowability because of a high concentration of toner particles T and hardly flows down on cleaning blade 10, thereby forming a toner deposit also on cleaning blade 10.

When the toner deposit is produced as described above, it is difficult to convey the toner deposit having a high concentration to the developer tank, and the deposited toner particles T are collected and wasted during cleaning. As a result, more toner particles are consumed, leading to a cost increase.

If the toner deposit is not removed, and left during suspension of wet development device 100 (wet image forming apparatus 1000), canier liquid C in the toner deposit is dried to form a solid of toner particles T. Toner particles T localized in the vicinity of the surface of development roller 4 are then removed before arriving at cleaning blade 10 and re-dispersed in carrier liquid C.

First Embodiment: Wet Development Device 100A

Figure 5:
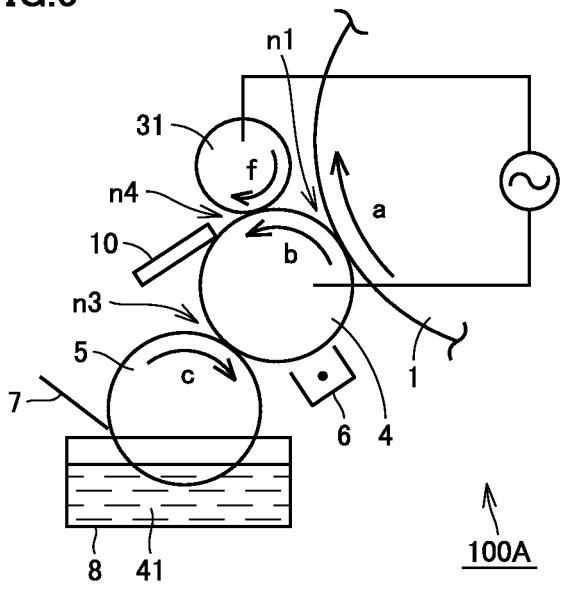
FIG. 5 is a diagram showing a configuration of a wet development device in a first embodiment.
Figure 6:
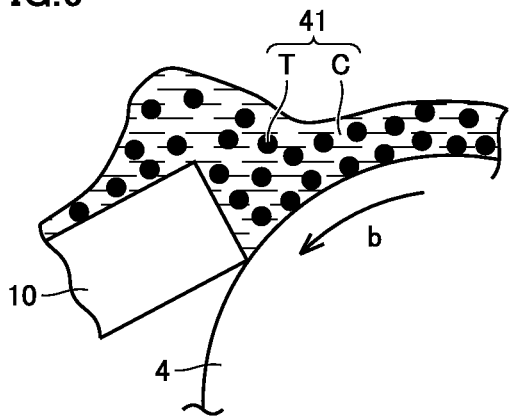
FIG. 6 is a schematic diagram showing a state of liquid developer reaching a cleaning blade on the development roller in the first embodiment.
Figure 7:
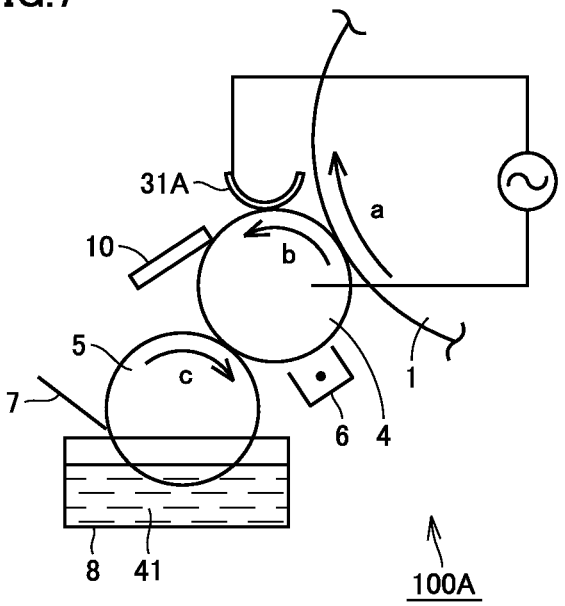
FIG. 7 is a diagram showing a stationary alternating bias applying member in the wet development device in the first embodiment.

Referring now to FIG. 5 to FIG. 7, a configuration of a wet development device 100A in the present embodiment will be described. FIG. 5 is a diagram showing a configuration of wet development device 100A in the present embodiment, and FIG. 6 is a schematic diagram showing a state of liquid developer 41 reaching cleaning blade 10 on development roller 4. FIG. 7 is a diagram showing a stationary alternating bias applying member 31A in wet development device 100A.

The basic configuration of this wet development device 100A is the same as wet development device 100 described above and differs in that an alternating bias applying member 31 is provided between development section n1 and cleaning blade 10 in contact with development roller 4 with liquid developer 41 interposed, for forming an alternating electric field between alternating bias applying member 31 and development roller 4. In the present embodiment, a conductive metal roller is used as alternating bias applying member 31.

With the rotation of development roller 4 (the direction b in the figure), carrier liquid C and toner particles T intrude into a nip n4 between alternating bias applying member 31 and development roller 4. As the intensity of the electric field increases, toner particles T present in the vicinity of the surface of development roller 4 start moving and reciprocate between development roller 4 and alternating bias applying member 31. Toner particles T, coining closer to the exit of nip n4, stop moving as the intensity of the electric field decreases, and toner particles T become uniformly dispersed in carrier liquid C shown in FIG. 2 described above.

Referring to FIG. 5, when liquid developer 41 in such a state reaches cleaning blade 10, toner particles T are collected without being deposited in the vicinity of cleaning blade 10. Alternating bias applying member 31 rotates in the direction f in FIG. 5. Although alternating bias applying member 31 may be rotated at the same velocity (linear velocity) as the surface velocity (linear velocity) of development roller 4, it is more preferable that alternating bias applying member 31 be rotated at a different velocity (linear velocity), because mechanical force of scraping off toner particles T acts.

The toner particles can be removed even with alternating bias with small amplitude, and an AC power supply with a smaller capacity can be used, leading to a cost reduction. In addition, local overcurrent is unlikely to occur, and damage to development roller 4 is small.

Although a metal roller in contact with development roller 4 has been described as alternating bias applying member 31, the essence lies in that a dispersion effect is achieved by the action of an alternating electric field on toner particles Tin liquid developer 41.

As long as liquid developer 41 is not blocked when reaching cleaning blade 10, the embodiments are not limited to a roller. The same effects can be achieved also by using an alternating bias applying member 31A formed with a bowl-shaped conductive stationary member, as shown in FIG. 7. When a bowl-shaped conductive stationary member is used, a driving device for the roller is unnecessary, leading to a cost reduction.

Examples of the material of the conductive roller as alternating bias applying member 31 include metals such as aluminum, iron, and stainless steel. The roller may have a conductive resin, rubber, or other elastic member on the surface of the metal base, and the surface of such a roller may be coated with an insulating material as thin as to be able to form an electric field. A variety of known materials used for forming a bias electric field in electrophotographic apparatuses can be used. When an elastic member is used, the peak pressure between alternating bias applying member 31 (31A) and development roller 4 can be reduced, and a permissible range of the settings can be increased with less blockage of liquid developer 41 at the nip entrance.

The same materials can be used for alternating bias applying member 31A with a fixed electrode, in place of the roller. The description of alternating bias applying member 31 (FIG. 6) is hereinafter applicable to alternating bias applying member 31A (FIG. 7).

The alternating bias applied to alternating bias applying member 31 may have a rectangular wave, a sinusoidal wave, a triangular wave, a sawtooth wave, a blank wave, or other waveforms. Preferable frequencies are about 1,000 Hz to 100,000 Hz. The frequencies of 1,000 Hz or higher can suppress local unevenness of the application state of alternating bias and areas with insufficient dispersion effects. The frequencies of 100,000 Hz or lower can achieve a good dispersion effect because toner particles move together. In order to facilitate the movement of toner particles and achieve a good dispersion effect, the amplitude is preferably 100 V (peak-to-peak amplitude of 200 V) or higher.

Since liquid developer 41 is insulative, when liquid developer 41 is interposed between development roller 4 and alternating bias applying member 31, a desired alternating bias can be applied, whereas if alternating bias is applied without liquid developer 41, that is, in a state in which development roller 4 and alternating bias applying member 31 are in direct contact with each other, a large amount of current flows, so that a desired alternating bias cannot be formed and the dispersion effect cannot be achieved. In some cases, overcurrent locally flows (leak occurs), thereby causing damage to development roller 4.

Although a desired bias can be formed by increasing the capacity of the alternating bias power supply to allow more current to flow, the probability that local overcurrent is produced increases, and current flowing when overcurrent is produced increases, thereby increasing the possibility of causing damage to development roller 4.

In order to allow liquid developer 41 to be interposed between development roller 4 and alternating bias applying member 31, it is necessary to examine the direction of rotation (the direction of the arrow f in FIG. 5) of alternating bias applying member 31 and the axial direction (the direction vertical to the drawing sheet of FIG. 5).

The direction of rotation can be controlled such that alternating bias is applied to alternating bias applying member 31 after liquid developer 41 is supplied to development roller 4 and conveyed to nip n4 of alternating bias applying member 31. Conversely, during suspension, the control can be performed such that the rotation of development roller 4 and supply roller 5 is stopped after alternating bias is cut off. This control allows liquid developer 41 to be interposed between development roller 4 and alternating bias applying member 31 while alternating bias is being applied.

Figure 8:
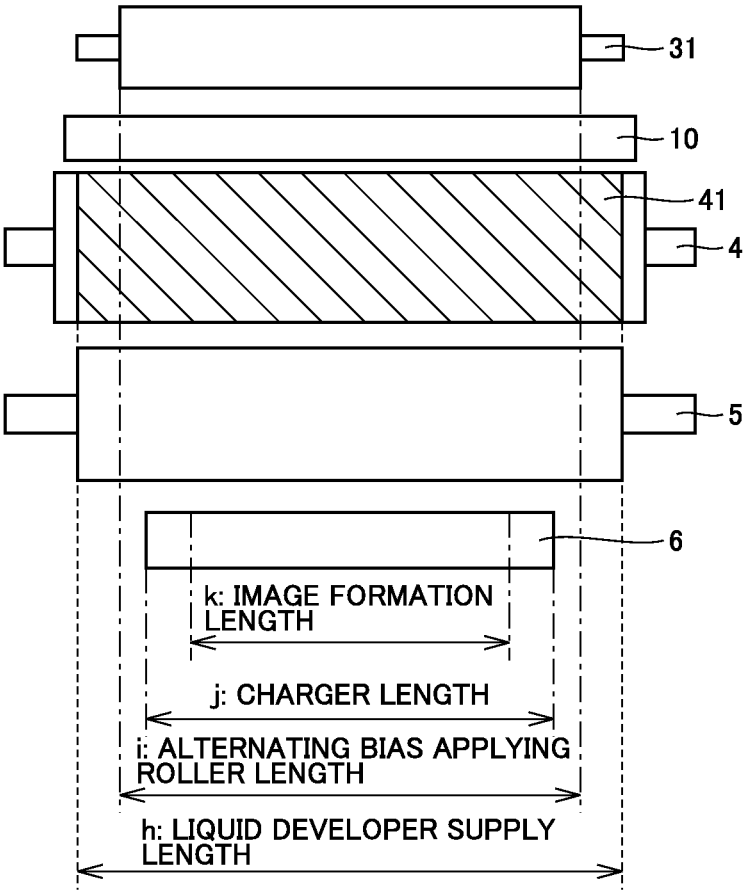
FIG. 8 is a diagram showing the positional relation of the supply length of liquid developer on the development roller, the alternating bias application length of an alternating bias applying roller of the alternating bias applying member, the charge length of the charger, and the image formation length by the charger in the first embodiment.

Referring now to FIG. 8, the positional relation between development roller 4 and alternating bias applying member 31 in the direction of axis of rotation of development roller 4 will be described. FIG. 8 shows the positional relation of a range (supply length h) in which liquid developer 41 is supplied onto development roller 4, a range (alternating bias application length i) in which alternating bias is applied from the alternating bias applying roller of alternating bias applying member 31, a range (charge length j) in which an electric charge is applied by charger 6, and a range (image formation length k) in which an image is formed on the image carrying member.

As shown in FIG. 8, when the alternating bias application length i of alternating bias applying member 31 is compared with the supply length h of liquid developer 41 supplied onto development roller 4, in the direction of axis of rotation of development roller 4, the alternating bias application length i of alternating bias applying member 31 is preferably located within the range of the supply length h of liquid developer 41.

Such a length relation can ensure that liquid developer 41 is interposed between development roller 4 and alternating bias applying member 31. Liquid developer 41 is thus interposed to act as an insulator in the area where alternating bias applying member 31 and development roller 4 are in contact with each other, thereby enabling application of a desired alternating bias. The application of alternating bias enables re-dispersion of toner particles on development roller 4 and suppresses a toner deposit.

In addition, local overcurrent (leak) is not produced between alternating bias applying member 31 and development roller 4, thereby suppressing damage to development roller 4. Moreover, cost reduction can be achieved because an AC power supply with a smaller capacity can be used. The probability that local overcurrent is produced is reduced, and even when local overcurrent is produced, the amount of current permitted to flow is small thereby reducing damage to development roller 4.

Considering an error in installation, the alternating bias application length i of alternating bias applying member 31 is preferably shorter than the supply length h of liquid developer 41 by 2 mm on one side, by 4 mm or more over the entire length.

The supply length h of liquid developer 41 may be defined (the state in FIG. 8) by holding liquid developer 41 over the entire length in the direction of axis of supply roller 5 and supplying the held liquid developer 41 to development roller 4. Alternatively, the supply length h of developer 41 on development roller 4 may be defined by using an anilox (engraving) roller having depressions on the surface as supply roller 5, with the engraving width shorter than the entire length of supply roller 5, and defining the length of liquid developer 41 held on supply roller 5.

As described above, liquid developer 41 can be interposed between development roller 4 and alternating bias applying member 31 to enable formation of a desired alternating bias, thereby preventing formation of a toner deposit because of the dispersion effect.

Second Embodiment

Figure 9:
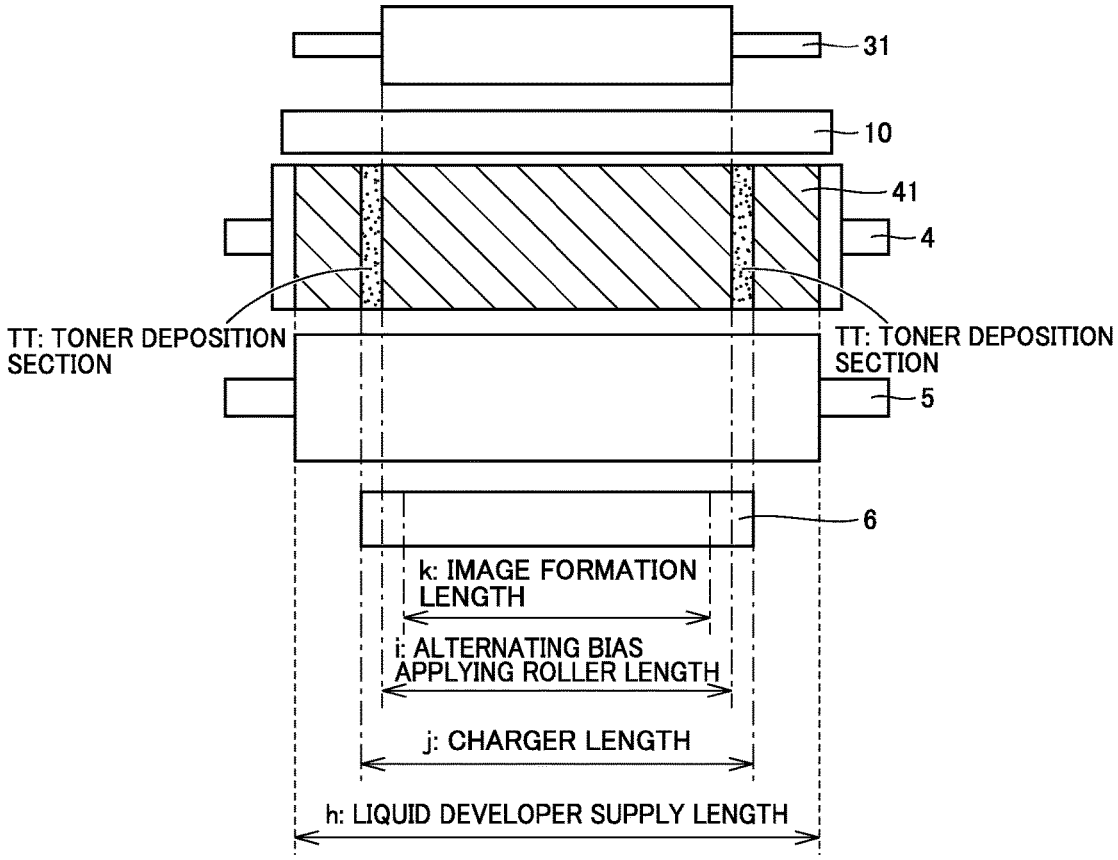
FIG. 9 is another diagram showing the positional relation between the development roller and the alternating bias applying member as viewed along the direction of axis of rotation of the development roller.

Referring now to FIG. 9, the other positional relation between development roller 4 and alternating bias applying member 31 as viewed along the direction of axis of rotation (the direction A in FIG. 9) of development roller 4 will be described. As shown in FIG. 9, even when the alternating bias application length i of alternating bias applying member 31 is located within the range of the supply length h of liquid developer 41, if the alternating bias application length i of alternating bias applying member 31 is shorter than the charge length j of charger 6, there arises an area where charger 6 acts and toner particles T is localized on the surface of development roller 4 but an alternating electric field does not act, and a toner deposit TT may be formed in that area (the dotted hatching section in FIG. 9).

As shown in FIG. 8, it is therefore preferable that the alternating bias application length i of alternating bias applying member 31 be located within the range of the supply length h of liquid developer 41 and that the charge length j of charger 6 be located within the range of the alternating bias application length i of alternating bias applying member 31 (the supply length h>the alternating bias application length i>the charge length j).

That is, it is preferable that the alternating bias application length i of alternating bias applying member 31 be located within the range of the supply length h of liquid developer 41 and that the charge length j of charger 6 be located within the range of the alternating bias application length i of alternating bias applying member 31 (the state shown in FIG. 8). With this configuration, the alternating bias can act on all of the toner particles localized on the surface of development roller 4 on development roller 4, thereby preventing formation of a toner deposit within the range of the supply length h of liquid developer 41 on development roller 4.

If the alternating bias application length i of alternating bias applying member 31 exceeds the charge length j of charger 6, there arises an area where charger 6 does not act but alternating bias acts. If charger 6 does not act, toner particles are not charged and not affected by the electric field at development section n1 or the alternating electric field at alternating bias applying member 31. As a result, a toner deposit is not formed.

Cleaning blade 10 for removing liquid developer 41 on development roller 4 is preferably provided over the length including the supply length h of developer 41 on development roller 4. The charge length j of charger 6 is preferably provided over the length including the image formation length k.

Third Embodiment

Figure 10:
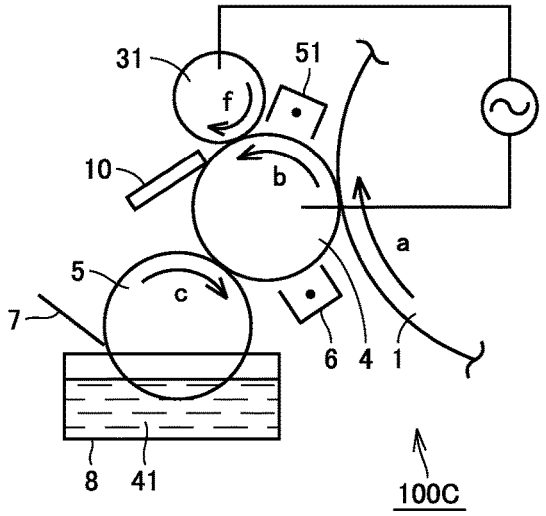
FIG. 10 shows a configuration of a wet development device in a third embodiment.

Referring now to FIG. 10, static charge elimination from toner particles upstream of alternating bias applying member 31 will be described. FIG. 10 shows a configuration of a wet development device 100C in the present embodiment. The basic configuration of this wet development device 100C is the same as wet development device 100A described above and differs in that a charge eliminating charger 51 is provided between development section n1 and alternating bias applying member 31 as a charge eliminator for applying an electric charge of polarity opposite to that of charger 6 to toner particles T on development roller 4.

In the present embodiment, a crotron charger (hereinafter referred to as a charge eliminating charger) similar to charger 6 is used for charge eliminating charger 51.

In wet development devices using wet development, if the amount of charge of toner particles is high, the image characteristics such as reproducibility of fine lines and evenness of a solid image (development with the same color on the entire page) are good. Conversely, the adherence of toner particles T to development roller 4 is strong in the background section to make cleaning difficult. It is therefore important to determine the amount of charge of toner particles, considering cleaning and deposition of toner particles.

Even when an alternating electric field is formed before cleaning as illustrated in the foregoing first and second embodiments, if the amount of charge of toner particles is large and the adherence of toner particles I to development roller 4 is strong, the force by an electric field is unable to remove toner particles T from the surface of development roller 4, thereby forming a toner deposit.

Charge eliminating charger 51 is therefore provided as in wet development device 100C shown in the present embodiment to enable adjustment of the amount of charge of toner particles before cleaning by cleaning blade 10. The amount of charge of toner particles before cleaning is thus kept constant independently of output from charger 6.

As a result, the adherence of toner particles T to development roller 4 before cleaning can be kept constant even with a higher output of charger 6. Accordingly, toner particles T can be removed from development roller 4 with the alternating electric field formed by alternating bias applying member 31, thereby suppressing a toner deposit.

The output of charger 6 can be increased, and a more excellent image can be output. Conversely, if charge eliminating charger 51 is provided without increasing the output of charger 6, the amount of charge of toner decreases, and the adherence of toner particles T to development roller 4 becomes weak, so that toner particles T can be removed with a smaller alternating bias (amplitude).

The charge elimination length of charge eliminating charger 51 is preferably equal to (overlapped with) the charge length j of charger 6. If the charge elimination length of charge eliminating charger 51 deviates from the charge length j of charger 6, there arises an area where only charger 6 acts or an area where only charge eliminating charger 51 acts, resulting in poor cleaning and deposition of toner particles.

Although a corotron charger is used as charge eliminating charger (charge eliminator) 51 in the foregoing description, any other configuration may be employed. For example, a conductive roller may be provided in contact with or in proximity to development roller 4 to apply a high voltage, causing discharge between the conductive roller and development roller 4.

As described above, charge eliminating charger 51 is provided so that an electric charge of polarity opposite to the toner charge polarity is applied from charge eliminating charger 51 to reduce the amount of charge of toner particles T. The amount of charge of toner particles reaching alternating bias applying member 31 can be controlled to be constant independently of the output of charger 6 (the amount of charge of toner), and an image can be formed with a higher amount of charge of toner.

In addition, the image quality such as reproducibility of fine lines and evenness of a solid image can be improved. Moreover, when the output of the charger is not increased, the amount of charge of toner is reduced by charge eliminating charger 51 and the adherence to development roller 4 decreases, so that toner particles can be removed even with alternating bias with small amplitude. An AC power supply with a smaller capacity can be used, leading to a cost reduction. Local overcurrent is less likely to be produced, thereby suppressing damage to development roller 4.

Charge eliminating charger 51 may be provided with a roller-shaped charge eliminating member. A charger wire may break over a long-time use, whereas the roller shape is not broken and can be used over a mechanical lifetime, thereby eliminating the need for maintenance and reducing running costs.

EXAMPLES

In order to confirm the effects of the foregoing embodiments, experiments were conducted under the conditions of Examples 1 to 3 and Comparative Example 1 shown in FIG. 11. The experiments were conducted using wet development device 100A shown in FIG. 5 under the conditions that the alternating bias application length i of alternating bias applying member 31 was varied and with or without charge eliminating charger 51, and the output of charger 6 was varied. In the experiments, photoconductor 1 was not used, and wet development device 100A alone was driven.

A rubber roller including a stainless core having a diameter of 20 mm and a conductive urethane layer having a thickness of 10 mm was used as development roller 4. An anilox roller having a diameter of 40 mm was used as supply roller 5. Development roller 4 was rotated at a velocity of 1000 mm/sec, and supply roller 5 was driven to rotate by development roller 4. Development roller 4 and supply roller 5 were grounded.

A corotron charger was used as charger 6, and the outputs of current flowing to development roller 4 at two levels, namely, 0.1 mA/m and 0.3 mA/m were evaluated. An aluminum roller having a diameter of 40 mm was used as alternating bias applying member 31 and driven at a velocity 1.5 times higher than the linear velocity of development roller 4.

Alternating current having a waveform formed by a function generator (WAVEFACTORY WF1944) manufactured by NF Corporation was amplified by an AC or DC high-voltage amplifier (Model 609E-6) manufactured by TREK, INC and applied. When charge eliminating charger 51 was provided, such a value was set that minimized the amount of the deposit in accordance with the output of charger 6. Here, the setting was such that current that is half the output of charger 6 was fed to development roller 4.

Under the conditions as described above, wet development device 100A was driven continuously for one hour, and the state of formation of a toner deposit was observed.

(Production of Coarsely-Ground Toner Particles)

After 100 parts of polyester resin and 15 parts of copper phthalocyanine were well mixed with a Henschel mixer (registered trademark), the mixture was molten and kneaded using an extruder with twin screws turning in the same direction with a heating temperature in the roll of 100° C. The resultant mixture was cooled and coarsely ground to obtain coarsely-ground toner particles.

(Production of Liquid Developer)

Liquid developer was obtained by mixing 75 parts of IPS 2028 (manufactured by Idemitsu Kosan CO., Ltd.), 25 parts of coarsely-ground toner particles, and 0.8 parts of V216 (manufactured by ISP Japan Ltd) as a dispersant, and wet-grinding the mixture with a sand mill for four days. The particle diameter of the toner particles was 2.0 μm. The particle diameter of the toner particles was measured by a laser diffraction particle size distribution measurement device (SALD-2200 (manufactured by Shimadzu Corporation).

Comparative Example 1

The length of each unit in wet development device 100A in Comparative Example 1 is as follows. All of the lengths below are as viewed along the direction of axis of rotation of development roller 4 shown in FIG. 8. This is applicable to Examples shown below.

The length of development roller 4 is 260 mm, the length of supply roller 5 is 250 mm, the supply length h of the liquid developer on development roller 4 is 250 mm, the charge length j of charger 6 is 240 mm, the alternating bias application length i of alternating bias applying member 31 is 254 mm, and the length of cleaning blade 10 is 260 mm (the alternating bias application length i (254 mm)>the supply length h (250 mm)>the charge length j (240 mm)). Charge eliminating charger 51 is not provided.

Example 1

In Example 1, in wet development device 100A, the alternating bias application length i of alternating bias applying member 31 is shorter than the supply length h of the liquid developer on development roller 4 and the charge length j of charger 6.

Specifically, the length of development roller 4 is 260 mm, the length of supply roller 5 is 250 mm, the supply length h of the liquid developer on development roller 4 is 250 mm, the charge length j of charger 6 is 240 mm, the alternating bias application length i of alternating bias applying, member 31 is 236 mm, and the length of cleaning blade 10 is 260 mm (the supply length h (250 mm)>the charge length j (240 mm)>the alternating bias application length i (236 mm)). Charge eliminating charger 51 is not provided.

Example 2

In Example 2, in wet development device 100A, the alternating bias application length i of alternating bias applying member 31 is shorter than the supply length h of the liquid developer on development roller 4 and longer than the charge length j of charger 6.

Specifically, the length of development roller 4 is 260 mm, the length of supply roller 5 is 250 mm, the supply length h of the liquid developer on development roller 4 is 250 mm, the charge length j of charger 6 is 240 mm, the alternating bias application length i of alternating bias applying member 31 is 246 mm, and the length of cleaning blade 10 is 260 mm (the supply length h (250 mm)>the alternating bias application length i (246 mm)>the charge length j (240 mm)). Charge eliminating charger 51 is not provided.

Example 3

In Example 3, in wet development device 100A, charge eliminating charger 51 is added to the configuration of Example 2 above and the charge of toner particles are eliminated before reaching alternating bias applying member 31.

Specifically, the length of development roller 4 is 260 mm, the length of supply roller 5 is 250 mm, the supply length h of the liquid developer on development roller 4 is 250 mm, the charge length j of charger 6 is 240 mm, the alternating bias application length i of alternating bias applying member 31 is 246 mm, and the length of cleaning blade 10 is 260 mm (the supply length h (250 mm)>the alternating bias application length i (246 mm)>the charge length j (240 mm)).

The charge elimination length of charge eliminating charger 51 is 240 mm, the output of charge eliminating charger is 0.05 mA/m, and the output of charger 6 is 0.1 mA/m.

(Evaluation Results)

FIG. 11 shows the evaluation results of Examples 1 to 3 and Comparative Example. In Comparative Example 1, the alternating bias application length i of alternating bias applying member 31 is longer than the supply length h of the liquid developer on development roller 4, and an area where liquid developer 41 is not present arises between alternating bias applying member 31 and development roller 4, so that a desired alternating electric field is not formed. As a result, the toner dispersion effect is insufficient, and a toner deposit is formed throughout the section opposed to charger 6. The evaluation is thus "F".

(Evaluation Result of Example 1)

The alternating bias application length i of alternating bias applying member 31 is shorter than the supply length h of the liquid developer on development roller 4, and liquid developer 41 is interposed throughout the area between alternating bias applying member 31 and development roller 4. As a result, a desired alternating electric field is formed between alternating bias applying member 31 and development roller 4 in the area where alternating bias applying member 31 is present, and no toner deposit is formed. The evaluation is thus "A".

(Evaluation Result of Example 2)

The alternating bias application length i of alternating bias applying member 31 is shorter than the supply length h of the liquid developer on development roller 4 and longer than the charge length j of charger 6. Liquid developer 41 is interposed throughout the area between alternating bias applying member 31 and development roller 4. A desired alternating electric field is formed between alternating bias applying member 31 and development roller 4 in the area where alternating bias applying member 31 is present. Since the alternating bias application length i of alternating bias applying member 31 is longer than the charge length j of charger 6, the alternating electric field can act on all of the toner particles T localized in the vicinity of the surface of development roller 4, and no toner deposit is formed throughout the developer supply width. The evaluation is thus "A".

(Evaluation Result of Example 3)

In the configuration of Example 3, charge eliminating charger 51 is added to the configuration of Example 2. The same evaluation "A" as in Example 2 is obtained, and even when the output of charge eliminating charger 51 is increased to 0.15 mA/m and the output of charger 6 is increased to 0.3 mA/m, no toner deposit is formed throughout the developer supply width. The evaluation is thus "A".

(First Modification)

Figure 12:
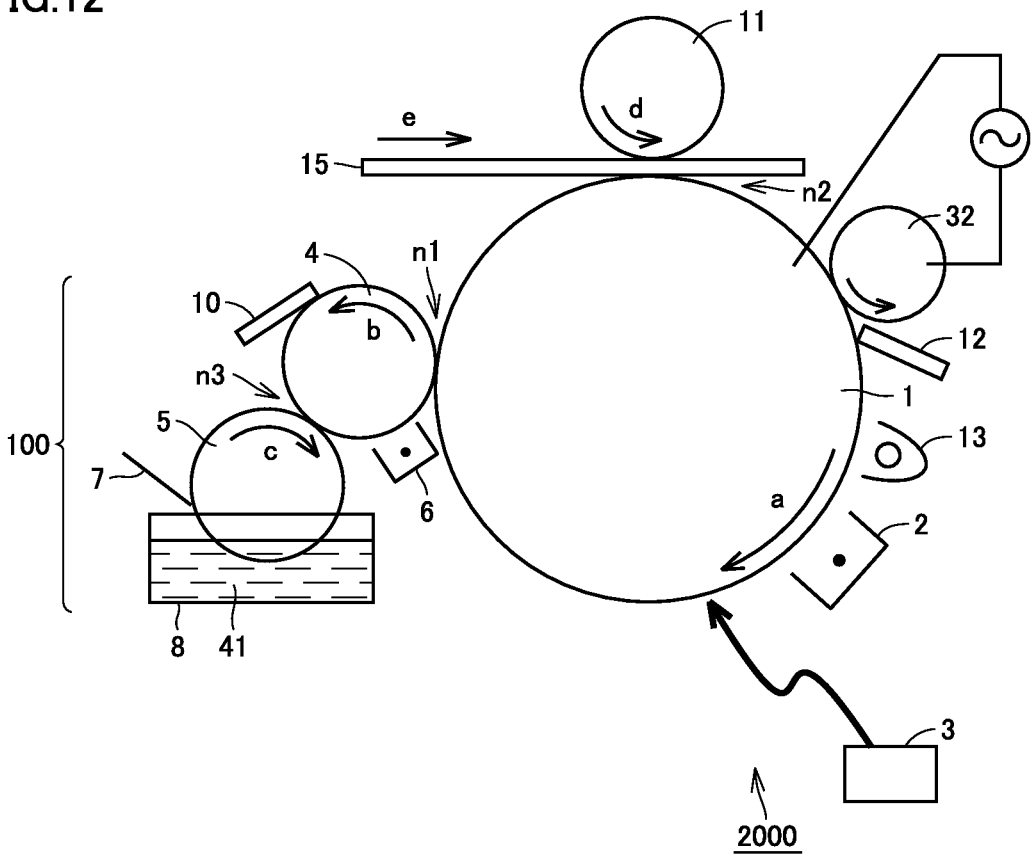
FIG. 12 shows a configuration of a wet image forming apparatus in a first modification.

In the foregoing embodiments, alternating bias applying member 31 is in contact with development roller 4, and the alternating bias application length i by alternating bias applying member 31 is within the range of the supply length h by development roller 4. However, as in a wet image forming apparatus 2000 shown in FIG. 12, an alternating bias applying member 32 may be provided at a position before cleaner 12 in contact with photoconductor 1.

That is, although toner particles are supplied to an electrostatic latent image on photoconductor 1, at least carrier liquid adheres in the same range as the supply length h by development roller 4. Then, the alternating bias application length of alternating bias applying member 32 in the direction of axis of rotation of development roller 4, that is, the direction of axis of rotation of photoconductor 1, is located within the range of the supply length h of liquid developer 41, so that local overcurrent between alternating bias applying member 32 and photoconductor 1 can be suppressed, and a toner deposit between photoconductor 1 and cleaner 12 can be suppressed without causing damage to photoconductor 1.

(Second Modification)

Figure 13:
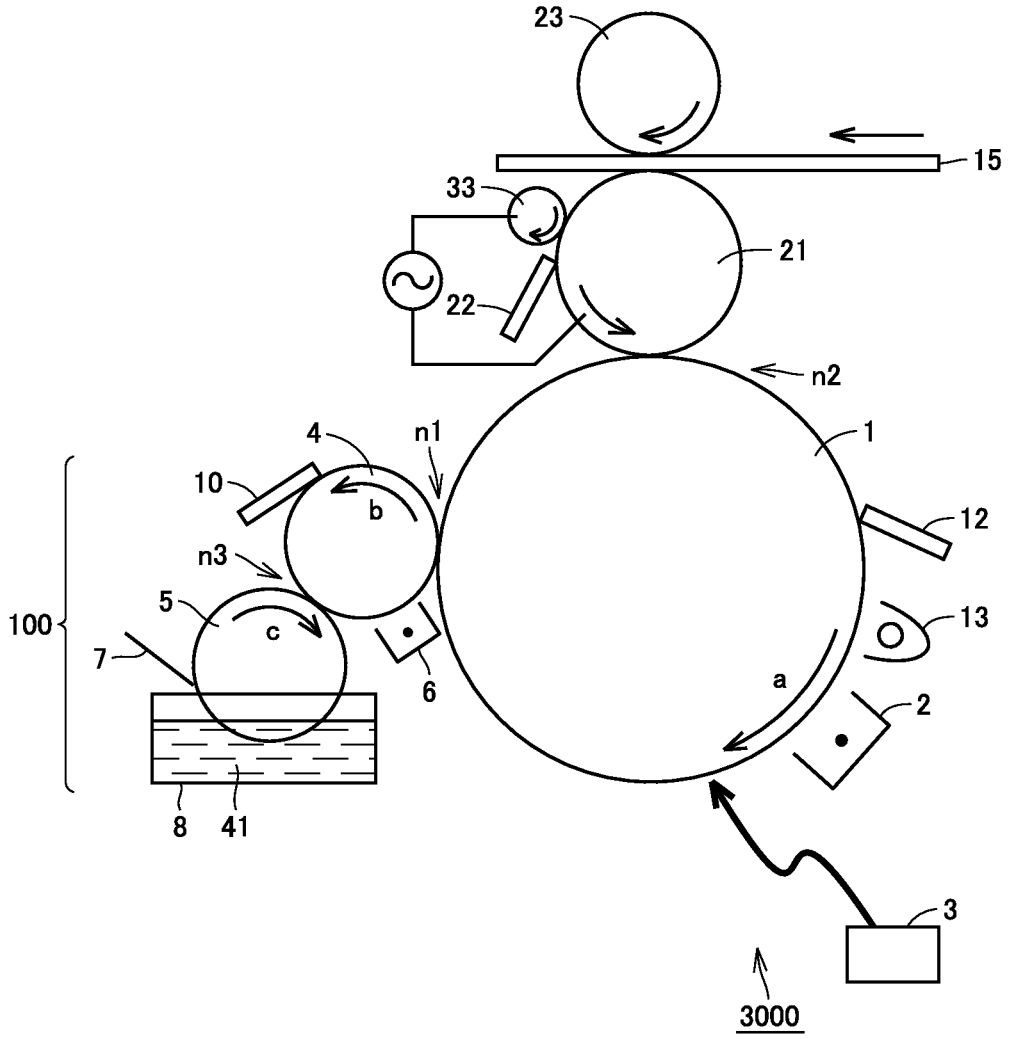
FIG. 13 shows a configuration of a wet image forming apparatus in a second modification.

FIG. 13 shows another example of the wet image forming apparatus. A wet image forming apparatus 3000 shown in FIG. 13 and wet image forming apparatus 1000 shown in FIG. 1 differ in that, in wet image forming apparatus 3000, the developer on photoconductor 1 is transferred and temporarily held on an intermediate transfer unit 21, and toner particles on intermediate transfer unit 21 are transferred onto object 15 conveyed between intermediate transfer unit 21 and a transfer roller 23. Transfer roller 23 is turned such that the surface moves in accordance with the rotation of photoconductor 1, and a voltage is applied such that the polarity for intermediate transfer unit 21 is opposite to that of the toner particles.

Intermediate transfer unit 21 is provided with a cleaner 22 and an alternating bias applying member 33 upstream from cleaner 22 in the rotational direction of intermediate transfer unit 21. Alternating bias applying member 33 forms an alternating electric field between alternating bias applying member 33 and intermediate transfer unit 21 to allow toner particles T to reciprocate, thereby suppressing deposition of toner between intermediate transfer unit 21 and cleaner 22.

In intermediate transfer unit 21, toner particles are localized at the image, and the carrier liquid adheres in the same range as the supply length h by development roller 4 although the amount of the carrier liquid is smaller than that on photoconductor 1. The alternating bias application length of alternating bias applying member 33 in the direction of axis of rotation of development roller 4, that is, in the direction of axis of rotation of photoconductor 1 is then located within the range of the supply length h of liquid developer 41, so that local overcurrent between alternating bias applying member 33 and intermediate transfer unit 21 can be suppressed, and a toner deposit between intermediate transfer unit 21 and cleaner 22 can be suppressed without causing damage to intermediate transfer unit 21.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet development device comprising:

a developer carrying member;

a supply member that supplies a liquid developer to the developer carrying member;

a charger that charges the liquid developer on the developer carrying member;

a cleaner that removes the liquid developer on the developer carrying member; and a bias applying member in direct physical contact with the developer carrying member and that applies alternating bias to the developer carrying member before removing by the cleaner, wherein in a direction in alignment with an axis of rotation of the developer carrying member, a maximum length along the developer carrying member to which the alternating bias is applied by the bias applying member is shorter than and located within a maximum length in which the liquid developer is supplied on the developer carrying member.

2. The wet development device according to claim 1, wherein in the direction in alignment with the axis of rotation of the developer carrying member, a length to which the liquid developer on the developer carrying member is charged by the charger is located in the length in which the alternating bias is applied by the bias applying member.

3. The wet development device according to claim 1, further comprising a charge eliminator that applies an electric charge of polarity opposite to that of the charger, upstream of the bias applying member in the direction of rotation of the developer carrying member.

4. The wet development device according to claim 1, wherein the bias applying member has a roller shape and rotates at a linear velocity different from that of the developer carrying member.

5. A wet image forming apparatus comprising:

an image carrying member;

an image forming unit that forms an electrostatic latent image on the image carrying member; and a wet development device that develops the electrostatic latent image formed on the image carrying member by the image forming unit, the wet development device including a developer carrying member, a supply member that supplies a liquid developer to the developer carrying member, a charger that charges the liquid developer on the developer carrying member, a cleaner that removes the liquid developer on the developer carrying member, and a bias applying member in direct physical contact with the developer carrying member and that applies alternating bias to the developer carrying member before removing by the cleaner, wherein in a direction in alignment with an axis of rotation of the developer carrying member, a maximum length along the developer carrying member to which the alternating bias is applied by the bias applying member is shorter than and located within a maximum length in which the liquid developer is supplied onto the developer carrying member.

* * * * *